US005876912A

United States Patent [19]

Crawley et al.

[11] Patent Number: 5,876,912

[45] Date of Patent: Mar. 2, 1999

[54] PYRAZOLO 1,5 A BENZIMIDAZOLE PHOTOGRAPHIC COLOR COUPLERS

[75] Inventors: Michael William Crawley, Kingswood/Watford Herts; Andrew William Gibson, Welwyn Garden City/Herts; Paul Louis Reginald Stanley, Wealdstone Harrow/Middlesex; Hugh Martin Williamson, Hanwell/London, all of United Kingdom

[73] Assignee: Eastman Kodak Company, Rochester, N.Y.

[21] Appl. No.: 827,980

[22] Filed: Apr. 27, 1995

Related U.S. Application Data

[63] Continuation of Ser. No. 160,321, Dec. 2, 1993, abandoned, which is a continuation of Ser. No. 934,462, filed as PCT/EP91/00512 Mar. 18, 1991 published as WO91/14970 Oct. 3, 1991, abandoned.

[30] Foreign Application Priority Data

Mar. 22, 1990 [GB] United Kingdom ..... 9006404

[51] Int. Cl.[6] ..... G03C 1/08; G03C 7/26; G03C 7/32

[52] U.S. Cl. ..... 430/558; 430/543; 430/955

[58] Field of Search ..... 430/558, 955, 430/543

[56] References Cited

U.S. PATENT DOCUMENTS

| | | | |
|---|---|---|---|
| 5,143,821 | 9/1992 | Crawley et al. | 430/558 |

FOREIGN PATENT DOCUMENTS

| | | | |
|---|---|---|---|
| 0310125 | 4/1989 | European Pat. Off. | 430/955 |
| 62-291654 | 12/1987 | Japan | 430/558 |
| 63-281161 | 11/1988 | Japan | 430/558 |
| 63-301950 | 12/1988 | Japan . | |

OTHER PUBLICATIONS

Research Disclosure 24241, Jun. 1984.

*Primary Examiner*—Geraldine Letscher
*Attorney, Agent, or Firm*—Arthur E. Kluegel

[57] ABSTRACT

Novel non-diffusible pyrazolo-[1,5-a] benzimidazole color couplers having an alkylene-, oxyalkylene- or arylene- thio coupling-off group, substituted with a carboxylic acid or dialkylamino group, have dye-forming and/or bleach-accelerating properties. The couplers are generally associated with a silver halide emulsion layer coated on a support to form a single color or multi-color photographic element.

9 Claims, No Drawings

PYRAZOLO 1,5 A BENZIMIDAZOLE PHOTOGRAPHIC COLOR COUPLERS

This is a Continuation of application Ser. No. U.S. Pat. Ser. No. 160,321 filed Dec. 2, 1993, which is a Continuation of U.S. Pat. Ser. No. 934,462, filed as PCT/EP91/00512 Mar. 18, 1991 published as WO91/14970 Oct. 3, 1991 (both now abandoned).

This invention relates to 4-H-pyrazolo-[1,5-a] benzimidazole magenta and cyan colour couplers.

4-H-Pyrazolo-[1,5-a]benzimidazole magenta and cyan colour couplers have the basic ring structure:

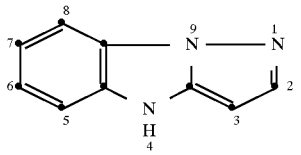

German Patent 1 070 030 describes pyrazolo[1,5-a] benzimidazole couplers which form a magenta dye on coupling. Specifically the 2-octadecyl and 2-phenyl derivatives are prepared. It also describes couplers containing 2-carboxy groups while German Specification 1 099 349A describes corresponding 2-sulpho derivatives, both of which being useful to prepare Fischer type dispersions.

2-Anilino derivatives described in Japanese Specification 51/26541 and German specification 2 156 111A are said to be more active than their 2-alkyl analogues.

The use of pyrazolobenzimidazoles with electron-withdrawing substituents as cyan couplers is disclosed in European Patent Specification Nos. 0271 063 and 0287 265.

Research Disclosure No. 242 June 1982 pages 286–292 discloses numerous ring compounds capable of releasing a development-influencing moiety, such as those carrying a thio substituent, to provide improved graininess and sharpness of image.

Japanese Patent Application 63/301950 describes couplers having thio coupling-off groups but nowhere is there disclosed such a group attached to a pyrazolobenzimidazole ring.

The present invention provides pyrazolo-[1,5-a] benzimidazole couplers having novel coupling-off groups with dye-forming and/or bleach-accelerating properties.

According to the present invention there are provided photographic non-diffusible pyrazolo-[1,5-a]benzimidazole colour couplers which have an alkylene- or oxyalkylene-thio coupling-off group substituted with a carboxylic acid or dialkylamino group.

A preferred class of the present couplers has the general Formula:

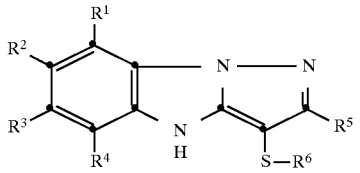

(1)

wherein $R^1$ to $R^5$ are each hydrogen or a substituent, and $R^6$ is an alkylene or oxyalkylene group substituted with a carboxylic acid or dialkylamino group, and wherein at least one of $R^1$ to $R^5$ contains a ballast group capable of rendering the coupler non-diffusible in photographic layers.

In formula (I), $R^1$ to $R^5$ may be any substituent which is not incompatible with the intended use of the coupler. Examples of groups which $R^1$ to $R^5$ may represent are H, R[where each R may be the same or different and is unsubstituted or substituted alkyl (including cycloalkyl), or aryl], Hal (e.g. Cl, Br or F), $CF_3$, $NO_2$, CN, OH, OR, $SO_2R$, $SO_3H$, $SO_3R$, $SO_2NH_2$, $SO_2NHR$, $SO_2NR_2$, $CONH_2$, CONHR, $CONR_2$, COOH, COOR, $NHSO_2R$, $NRSO_2R$, NHCOR, NRCOR, NH NHR, $NR_2$ and SR. The preferred groups For magenta couplers for $R^1$ to $R^4$ are H, R, NHCOR and $NHSO_2R$ and for $R^5$ are R, OR and NH-aryl.

Examples of groups which R may represent are $(CH_2)_mNR_2^7$, wherein $R_7$ is a substituted or unsubstituted alkyl group and m=1–5, in particular m=2, or preferably a group $R^8COOH$ wherein $R^8$ is a substituted or unsubstituted $(CH_2)_n$ or $(CH_2O)_n$ group, wherein n=1–5, or a group CHR. Most preferably $R^8$ is an ethylene group.

Compounds of formula (I) have thio coupling-off groups which can be released on coupling with an oxidised colour developer thereby acting as a bleach accelerating agent, allowing for shorter processing times without loss of image quality.

Those specific compounds of formula (I') which include a carboxy group

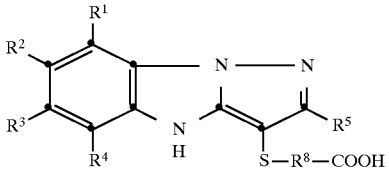

(I')

Form dyes either magenta or cyan in hue having superior coupling activity leading to higher dye density yields.

Specific examples of couplers of formula (I) and (I') are listed in the Following table:

TABLE I

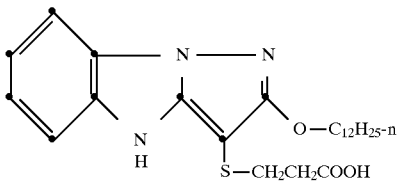

(1)

TABLE I-continued
(2)
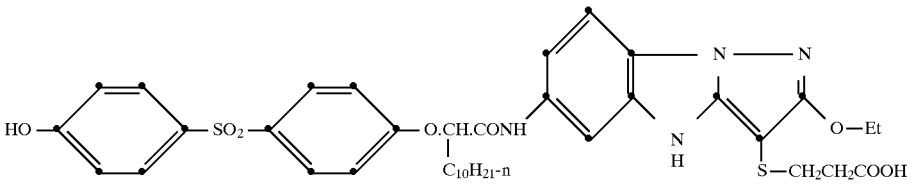
(3)
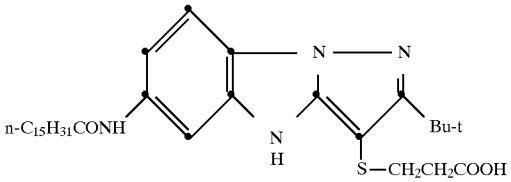
(4)
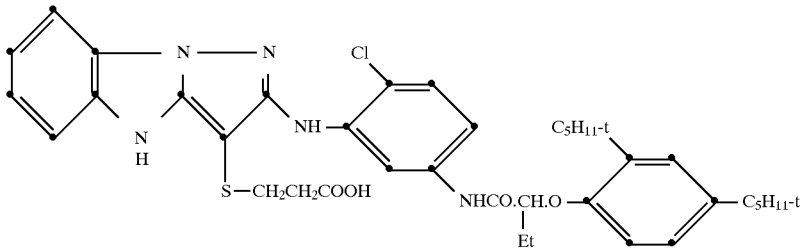
(5)
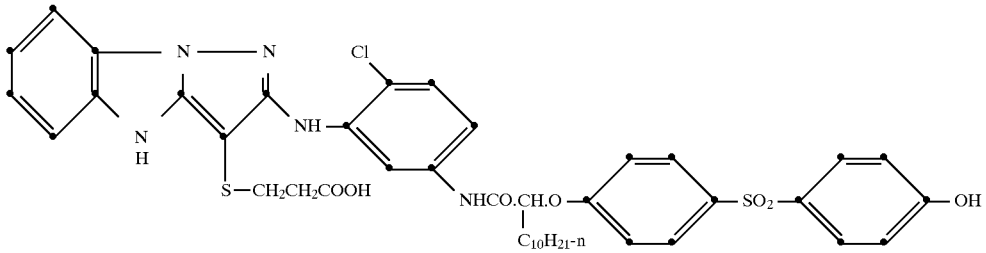
(6)
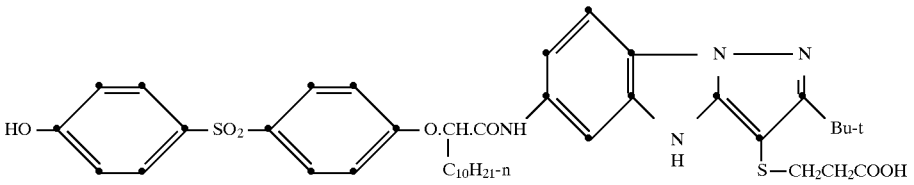
(7)
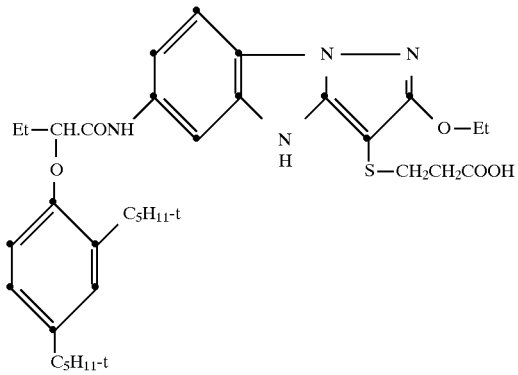

TABLE I-continued (8)

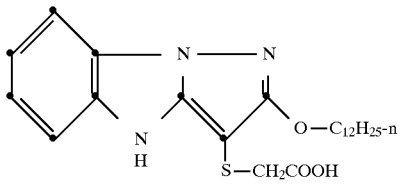

Examples of comparative couplers without the activating coupling-off groups are listed in Table II below.

TABLE II (C1)

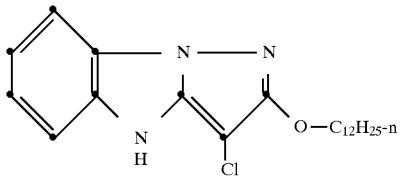

(C2)

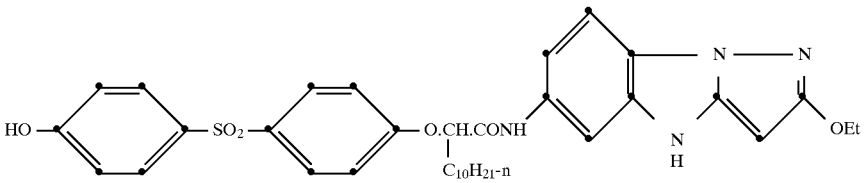

(C3)

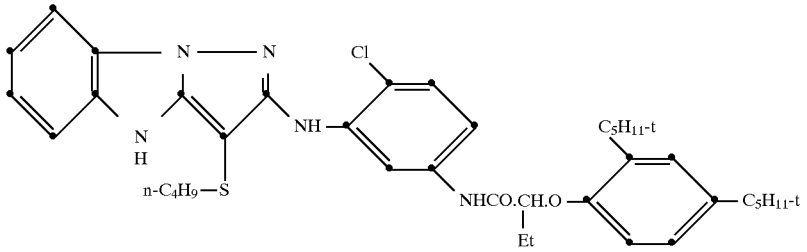

The present couplers may be prepared by methods in themselves known as exemplified in the preparative Examples 3, 4 and 5, below.

The dye-forming couplers of this invention can be used in the ways and for the purposes that dye-forming couplers have been previously used in the photographic art.

Typically, the couplers are associated with a silver halide emulsion layer coated on a support to form a photographic element. As used herein, the term "associated with" signifies that the coupler is incorporated in the silver halide emulsion layer or in a layer adjacent thereto where, during processing, it is capable of reacting with silver halide development products.

The photographic elements can be single colour elements or multicolour elements. In a multicolour element, the magenta dye-forming couplers of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively, at least one of the magenta or cyan dye-forming couplers being a coupler of this invention. The element can contain additional layers, such as filter and barrier layers.

In the following discussion of suitable materials for use in the emulsions and elements of this invention, reference will be made to Research Disclosure, December 1989, Item 308119, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. The couplers of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardeners (see Research Disclosure Section X), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye. The coupling-off group thereby released accelerates the subsequent bleaching of photographically generated silver.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxy-ethyl)-m-toluidine di-p-toluene sulphonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following Examples are given for a better understanding of the invention.

EXAMPLE 1

Comparison of Activities of Pyrazolobenzimidazole Couplers of the Invention with Activities of Pyrazolobenzimidazole Couplers of the Prior art.

The couplers were incorporated into a photographic silver bromoiodide emulsion and coated in the following format:

| | | |
|---|---|---|
| Gel supercoat | gelatin | 1.5 $gm^{-2}$ |
| Emulsion | Silver bromoidide | 1.61 $gm^{-2}$ |
| Layer | Coupler | 1.04 $mmolm^{-2}$ |
| | Gelatin | 2.42 $gm^{-2}$ |
| | Bis(vinylsulphonyl)-methane (hardener) | 0.06 $gm^{-2}$ |
| Support | Cellulose acetate | |

The couplers dispersion used contained 6% w/w gelatin, 8.8% coupler and coupler solvents in the ratio coupler:tricresyl phosphate:2-(2-butoxyethoxy)ethyl acetate 1:0.5:1.5.

On fogging and processing through a standard C-41 process, the dye hues were measured.

The data in the following table shows that pyrazolobenzimidazole couplers of the invention have greater activity than the comparison couplers as evidenced by superior $D_{max}$ and gamma (γ).

| Coupler | | Dmax | Dmin | γ | $\lambda_{max}$/nm | HBW/nm |
|---|---|---|---|---|---|---|
| (1) | (Invention) | 2.10 | 0.21 | 2.78 | 546.5 | 107 |
| (C1) | (Comparison) | 0.84 | 0.17 | 0.60 | 544.5 | 100 |
| (2) | (Invention) | 2.98 | 0.18 | 3.52 | 555.5 | 113 |
| (C2) | (Comparison) | 0.89 | 0.12 | 0.69 | 558.0 | 115 |
| (4) | (Invention) | 2.66 | 0.15 | 3.12 | 535.0 | 137 |
| (C3) | (Comparison) | 0.47 | 0.15 | 0.27 | — | — |
| (7) | (Invention) | 2.93 | 0.25 | 3.80 | 557 | 109 |
| (C2) | (Comparison) | 0.89 | 0.12 | 0.69 | 558 | 115 |

EXAMPLE 2

Comparison of Bleaching Times of Pyrazolobenzimidazole Couplers of the Invention with Bleaching Times of Pyrazolobenzimidazole Couplers of the Prior art Each coupler was incorporated into a single layer coating format as described in Example 1 and a strip of film containing the coupler fogged and developed in C41 developer to generate the strip containing dye and silver. Each strip was then plunged into C41 bleach II and the rate of silver density disappearance followed by infra-red measurement.

The data in the following table shows that the time to completely bleach the coatings was significantly less with the pyrazolobenzimidazole couplers of the invention than with the closely related control couplers:

| Coupler | | Time to bleach the coating (secs) | Reduction in Bleaching Time |
|---|---|---|---|
| (1) | (Invention) | 16.2 ± 1 | 17% |
| (C1) | Comparison) | 19.5 ± 1 | |
| (2) | (Invention) | 17.2 ± 1 | 17% |
| (C2) | (Comparison) | 20.7 ± 1 | |
| (4) | (Invention) | 19 ± 0.5 | 29.6% |
| (C3) | (Comparison) | 27 ± 0.5 | |

EXAMPLE 3

Preparation of 3-(2-Dodecyloxy-4-H-pyrazolo[1,5-a]-benzimidazol-3-ylthio)propionic acid. (Coupler 1)

(a) O-Dodecyl-2-ethoxycarbonylacetimidate hydrochloride

Ethyl cyanoacetate (84.8 g, 0.75 mole) and dodecyl alcohol (140 g, 0.75 mole) were dissolved in diethyl ether (120 ml). The stirred solution was saturated with HCl gas over a period of 1.5 hrs whilst being cooled in an ice bath. A further quantity of ether was added (300 ml), and the clear solution was stirred in an ice/salt bath for 1.5 hrs to precipitate the product. The mixture was stood in a cool room at 4° C. overnight, the crystalline solid filtered off, washed with a little ether, and dried under vacuum at 20° C., (yield=30.27 g.). The mass spectrum and elemental analysis results were consistent with the product being O-dodecyl-2-dodecyloxycarbonylacetimidate hydrochloride. The filtrate was placed in the fridge overnight, and this precipitated a further quantity of crystals. These were filtered off, washed with ether, and dried under vacuum at 20° C. Analysis was consistent with the desired product, O-dodecyl-2-ethoxycarbonylacetimidate hydrochloride.

The yield was 100.87 g, 40%.

Analysis; calculated for $C_{14}H_{34}ClNO_3$ Calc: C 60.8%, H 10.2%, Cl 10.6%, N 4.2% Found: C 60.3%, H 10.1%, Cl 10.0%, N 4.1%

(b) 3-Dodecyloxy-1-(2-nitrophenyl)pyrazol-5-one

2-Nitrophenylhydrazine (16.1 g, 105 mmole) was stirred in tertiary butyl alcohol (150 ml), and O-dodecyl-2-ethoxycarbonylacetimidate hydrochloride (35.0 g, 105 mmole) added with stirring. After 1.5 hr at room temperature, the formation of the intermediate hydrazone was complete. The reaction mixture was brought to reflux temperature, a solution of sodium hydroxide in water (140 ml, 0.2 g/ml) was added, and heating was continued for a further 10 min. The solution was allowed to cool and was drowned in dilute (5%) hydrochloric acid (21). The crude product was extracted into ethyl acetate, and the extracts were combined, dried with magnesium sulphate, and concentrated by rotary evaporation. The product was purified by column chromatography on silica gel, using an ethyl acetate/60°–80° C. petroleum ether mixture (1:2) as eluant. The solid was further purified by recrystallisation from ethyl acetate:60°–80° C. petroleum ether (1:9) to give the product, 3-dodecyloxy-1-(2-nitrophenyl)pyrazol-5-one, as a brown solid. The yield was 8.0 g, 20%.

Analysis; Calculated for $C_{21}H_{31}N_3O_4$ Calc: C 64.8%, H 8.0%, N 10.8% Found: C 65.2%, H 8.3%, N 10.5%

(c) 2-Dodecyloxy-4-H-pyrazolo[1,5-a]benzimidazole

3-Dodecyloxy-1-(2-nitrophenyl)pyrazol-5-one (8.0 g, 20.54 mmole) was dissolved in acetic acid (200 ml), and 10% palladium on charcoal (0.8 g) in acetic acid (10 ml) added. The reaction mixture was hydrogenated under pressure for a period of 1.5 hrs. The catalyst was filtered from the mixture to leave a solution of the 3-alkoxy-1-(2-aminophenyl)pyrazol-5-one in acetic acid. Cyclisation was effected by heating the acetic acid solution under reflux for fifteen minutes. The solution was allowed to cool, and the solvent was removed by rotary evaporation to give the crude product as a dark orange solid. Recrystallisation, once from acetonitrile, and three times from an ethyl acetate/60°–80° C. petroleum ether mixture (1:2), gave pure 2-dodecyloxy-4-H-pyrazolo-[1,5-a]benzimidazole. The yield was 3.97, 57%.

Analysis; Calculated for $C_{21}H_{31}N_3O_1$ Calc: C 73.9%, H 9.2%, N 12.3% Found: C 73.7%, H 9.2%, N 12.2%

(d) 3-(2-Dodecyloxy-4-H-pyrazolo[1,5-a]benzimidazol-3-ylthio)propionic acid. (Coupler 1)

Coupler (2c) (3.91 g, 11.45 mmole) and 3-mercaptopropionic acid (1.22 g, 11.45 mmole) were stirred in dimethylformamide (60 ml), and a solution of bromine (2.93 g, 18.3 mmole) in dimethyl formamide (10 ml) was added dropwise until about a quarter of the bromine solution remained. The reaction mixture was then stirred at room temperature for two hours. The remaining bromine solution was then added in a dropwise manner, and the mixture was allowed to stir for a further thirty minutes. The solution was drowned in dilute hydrochloric acid (600 ml), and the crude product was extracted into ethyl acetate. The extracts were combined, dried with magnesium sulphate, and concentrated by rotary evaporation to give a brown oil. The crude product was purified by column chromatography on silica gel, using an ethyl acetate/60°–80° C. petroleum ether mixture (1:1) as eluant. The product was further purified by recrystallisation from an ethyl acetate/petroleum ether mixture, to give pure 3-(2-dodecyloxy-4-H-pyrazolo [1,5-a]benzimidazol-3-ylthio)-propionic acid. The yield was 3.77 g, 74%.

Analysis; Calculated for $C_{24}H_{34}N_3O_3S_1$ Calc: C 64.7%, H 7.9%, N 9.4%, S 7.2% Found: C 64.8%, H 7.9%, N 9.3%, S 6.8%

EXAMPLE 4

Preparation of N-(2-Ethoxy-3-(2-carboxyethylthio)-pyrazolo-4H-benzimidazol-6-yl)-2-[4-(4-hydroxy-phenyl-sulphonyl)phenoxy]undecylamide. (Coupler 2)

(a) N-(4-Fluoro-3-nitrophenyl)-2-[4-(4-hydroxyphenylsulphonyl)phenoxy]undecylamide 2-[4-(4-acetoxyphenylsulphonyl)phenoxy]undecanoic acid (98.0 g, 0.2 mole) was refluxed with thionyl chloride (120 ml) for 45 mins. The excess thionyl chloride was removed by rotary evaporation, 60°–80° C. petroleum ether (50 ml) added and the solvent again removed. This last step was repeated twice more to remove the last traces of thionyl chloride. The acid chloride was obtained as a clear oil in quantitative yield (102.7 g). 4-Fluoro-3-nitroaniline (31.22 g, 0.2mole) was dissolved in tetrahydrofuran (600 ml) and pyridine (200 ml) and a solution of the above acid chloride (102.7 g, 0.2 mole) in tetrahydrofuran (300 ml) added over a period of 1 hr. The mixture was stirred at room temperature for 2 hr and then poured into dilute (5%) hydrochloric acid solution (81). The gummy solid was extracted into ethyl acetate, washed with water and dried over magnesium sulphate. Removal of the solvent gave the crude acylated product as an oil which was dissolved in ethanol (500 ml) with warming, cooled to 20° C. and stirred while a solution of sodium hydroxide (350 ml, 4M) was added. The mixture was stirred for 1 hr, poured into dilute (5%) hydrochloric acid (41) and the gum obtained extracted into ethyl acetate. The extract was washed with water,dried over magnesium sulphate and the solvent removed by rotary evaporation. The residue was crystallised from ethyl acetate and 60°–80° C. petroleum ether to give the product as a pale yellow solid, 86.8 g, 74%.

Analysis; calculated for $C_{30}H_{35}FN_2O_7S$ Calc: C 61.4%, H 6.0%, N 4.8%, S 5.5% Found: C 61.4%, H 6.0%, N 4.6% S 5.5%

(b) Preparation of N-(4-Hydrazino-3-nitrophenyl)-2-[4-(4-hydroxyphenylsulphonyl)phenoxy]undecylamide N-(4-Fluoro-3-nitrophenyl)-2-[4-(4-hydroxyphenylsulphonyl)-phenoxy]undecylamide (86.0 g, 147.0 mmole) was dissolved in dimethyl sulphoxide (500 ml), and hydrazine monohydrate (17.8 g, 355 mmole) was added in a dropwise fashion whilst keeping the temperature below 40° C. The reaction mixture was stirred for 1.5 hr at room temperature, and was then drowned in an ice/brine mixture (61). The red solid obtained was filtered off and dried at room temperature. The product was used in this crude form without any further purification.

(c) N-[3-Nitro-4-(3-ethoxy-5-pyrazolon-1-yl)phenyl]-2-[4-(4-hydroxyphenylsulphonyl)phenoxy]undecylamide.

N-[3-nitro-4-(3-ethoxy-5-pyrazolon-1-yl)phenyl]2- [4-(4-hydroxyphenylsulphonyl)phenoxy]undecylamide was prepared by the method in (2b) from N-(4-hydrazino-3-nitrophenyl)- 2-[4-(4-hydroxyphenylsulphonyl)phenoxy] undecylamide (3b) and O-ethyl 2-ethoxycarbonylacetimidate hydrochloride (prepared from ethyl cyanoacetate and ethanol as in method (2a)). The crude product was partially purified by column chromatography using 63–200 mesh silica gel and ethyl acetate/60°–80° C. petroleum ether (1:1) as the eluent. The yield was 29% over the two stages (3a) to (3c).

Analysis; Calculated for $C_{35}H_{42}N_4O_9S$ Calc: C 60.5%, H 6.1%, N 8.1%, S 4.6% Found: C 59.2%, H 6.0%, N 7.5%, S 5.0%

(d) N-(2-Ethoxypyrazolo-4H-benzimidazol-6-yl)-2-[4-(4-hydroxy-phenylsulphonyl)phenoxy]undecylamide. (Coupler C2)

N-(2-Ethoxypyrazolo-4H-benzimidazol-6-yl)-2-[4-(4-hydroxy- phenylsulphonyl)phenoxy]undecylamide was prepared from (3c) using the method indicated in (2c). The crude product was purified by column chromatography using 63–200 mesh silica gel and ethyl acetate/60°–80° C. petroleum ether (2:1) as the eluent, followed by an acetonitrile slurry. The yield of cream solid was 8.15 g, 30%.

Analysis; Calculated for $C_{35}H_{42}N_4O_6S$ Calc: C 65.0%, H 6.6%, N 8.7%, S 5.0% Found: C 64.6%, H 6.6%, N 8.3%, S 5.3%

(e) N-(2-Ethoxy-3-(2-carboxyethylthio)-pyrazolo-4H-benzimidazol-6-yl)-2-[4-(4-hydroxyphenylsulphonyl)-phenoxy]undecylamide. (Coupler 2)

Coupler (C2) (5.17 g, 8.0 mmole) and 3-mercaptopropionic acid (0.85 g, 8.0 mmole) were stirred in dimethylformamide (60 ml) and a solution of bromine (2.05 g,12.8 mmole) in dimethyl-formamide (10 ml) added dropwise until ¼ of the bromine solution remained. The mixture was stirred 2 hrs at room temperature, the remaining bromine solution added dropwise, and stirring continued for 30 mins. The mixture was poured into dilute (5%) hydrochloric acid (1.21) and the solid filtered off, washed and dried in air. The product was purified by column chromatography using 63–200 mesh silica gel as the absorbant. Ethyl acetate was used to elute the major impurities and the product was eluted with 2% acetic acid in ethyl acetate. Further purification was achieved by a hot ethanol slurry to give pure product as a white solid, 2.8 g, 47% yield.

Analysis; Calculated for $C_{38}H_{46}N_4O_8S_2$ Calc: C 60.8%, H 6.2%, N 7.5%, S 8.5% Found: C 60.5%, H 6.0%, N 7.6%, S 8.6%

EXAMPLE 5

Preparation of $^3$-((2-{2-chloro-5-[2-(2,4-di-t-pentylphenoxy)propanamido]anilino}-4-H-pyrazolo [1,5-a]-benzimidazol-3-ylthio))propionic acid. (Coupler 4)

(a) 1-(o-Nitrophenyl)-3-{2-chloro-5-[2-(2,4-di-t-pentylphenoxy)propanamido]anilino}pyrazol-5-one 2-Chloro-5-[2-(2,4-di-t-pentylphenoxy)propanamido] aniline (42.17 g, 95 mmoles) was dissolved in a warm (60° C.) mixture of methanol (100 ml) and toluene (150 ml) and then 2-ethoxycarbonylacetimidate hydrochloride (18.6 g, 95 mmoles) was added portionwise as a solid. The resulting solution was stirred for three hours at 60° C. during which time a white precipitate formed. After this time the mixture was allowed to cool to 30° C. and more toluene (100 ml) was added. The precipitate was filtered and washed with toluene and the filtrate was concentrated under reduced pressure to leave a brown oil. The oil was dissolved in glacial acetic acid (150 ml) and o-nitrophenyl hydrazine (14.53 g, 95 mmoles) was added portionwise. The resulting red coloured mixture was heated to 60° C. for 18 hours. After this time the solvents were removed under reduced pressure to leave a viscous red oil. This was dissolved in methanol (250 ml) and a freshly prepared solution of sodium (9.5 g, 413 mmoles) in methanol (500 ml) added. The resulting purple coloured mixture was stirred at room temperature for 15 minutes before being poured onto dilute hydrochloric acid (10 1) A yellow-brown solid precipitated which was filtered and dried in the air (51.61 g). The pure product was obtained as a bright yellow solid from this crude material by column chromatography using silica gel (63–200 mesh) as solid phase and ethyl acetate and 60°–80° C. petroleum, in the ratio of 30:70, as eluent.

Analysis; Calculated for $C_{35}H_{42}ClN_5O_5$ Calc: C 64.85%, H 6.5%, Cl 5.5%, N 10.8% Found: C 64.7%, H 6.7%, Cl 5.7%, N 10.2%

(b) 1-(o-aminophenyl)-3-{2-chloro-5-[2-(2,4-di-t-pentylphenoxy)propanamido]anilino}pyrazol-5-one The o-nitro pyrazolone (8.48 g, 13 mmoles) was dissolved in tetrahydrofuran (250 ml) and a catalytic amount of Raney Nickel catalyst added. The mixture was hydrogenated under 30 atmospheres of hydrogen at ambient temperature for 5.5 hours. After this time the catalyst was filtered off and the solvent removed under reduced pressure to leave a grey-coloured solid (pure by TLC). The product was used without further purification.

(c) 2-{2-chloro-5-[2-(2,4-di-t-pentylphenoxy) propanamido]anilino}-4-H-pyrazolo[1,5-a]benzimidazol The o-amino pyrazolone was dissolved in refluxing isopropanol (200 ml) and concentrated hydrochloric acid (5 ml) was added. Heating was continued for a further two hours and then the solution was allowed to cool before being poured onto a solution of sodium hydrogen carbonate (19 g) in water (41) to precipitate a cream coloured solid. This was filtered, washed with water and dried to give the crude product. Pure material was obtained by recrystallisation from a mixture of ethyl acetate and 60–80 petroleum (4.83 g, 62%).

Analysis; Calculated for $C_{35}H_{42}ClN_5O_2$ Calc: C 70.0%, H 7.0%, Cl 5.9%, N 11.7% Found: C 69.9%, H 7.1%, Cl 5.8%, N 11.4%

(d) 3-((2-{2-chloro-5-[2-(2-(2,4-di-t-pentylphenoxy) propanamido-]anilino}-4-H-pyrazolo[1,5-a]benzimidazol-3-ylthio))propionic acid. (Coupler 4) The 2-chloro benzimidazol (11.99 g, 20 mmole) and mercaptopropionic acid (2.12 g, 20 mmoles) were dissolved in dimethylformamide (100 ml) and a solution of bromine (4.16 g, 26 mmoles) in dimethylformamide (20 ml) added dropwise. The mixture was then stirred for 4.5 hours before being poured onto brine (4.51). A light brown coloured solid precipitated which was filtered and dried (15.73 g). Pure product (5.35 g, 38%) was obtained from this by column chromatography using silica gel (63–200 mesh) as solid support and ethyl acetate as eluent.

Analysis; Calculated for $C_{38}H_{46}ClN_5O_4S$ Calc: C 64.8%, H 6.6%, N 9.9% Found: C 64.2%, H 6.6%, N 9.6%

All the products demonstrated satisfactory mass and proton NMR spectra.

We claim:

1. A photographic material comprising a support, a silver halide emulsion layer and, associated therewith, a coupler which is a non-diffusible pyrazolo-[1,5-a]benzimidazole color coupler which has the general formula:

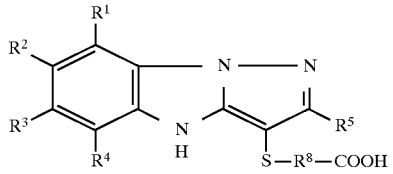

(I')

wherein $R^1$ to $R^5$ are each hydrogen or a substituent, and wherein at least one of $R^1$ to $R^5$ contains a ballast group capable of rendering the coupler non-diffusible in photographic layers; and $R^8$ represents a substituted or unsubstituted alkylene group or CHR wherein R is a substituted or unsubstituted alkyl group.

2. The material of claim 1 wherein $R^8$ has the formula $(CH_2)_n$ where n is 1 to 5.

3. The material of claim 1 wherein $R^8$ is $CH_2$, $CH_2CH_2$, $CH_2CH_2CH_2$ or $CH(CH_3)$.

4. The material of claim 3 wherein $R^8$ is $CH_2CH_2$.

5. The material of claim 1 in which $R^1$ to $R^5$ independently represent H, R, Cl, Br, F, $CF_3$, $NO_2$, CN, OH, OR, $SO_2R$, $SO_3H$, $SO_3R$, $SO_2NH_2$, $SO_2NHR$, $SO_2NR_2$, $CONH_2$, CONHR, $CONR_2$, COOH, COOR, $NHSO_2R$, $NRSO_2R$, NHCOR, NRCOR, $NH_2$, NHR, $NR_2$ and SR, wherein each R may be the same or different and is substituted or unsubstituted alkyl (including cycloalkyl) or aryl.

6. The material of claim 5 in which $R^1$ to $R^4$ independently represent H, R, NHCOR or $NHSO_2R$.

7. The material of claim 1 in which $R^5$ represents R, OR or NH-aryl.

8. The photographic material of claim 1 wherein the coupler is selected from the group consisting of the following:

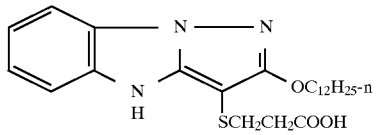

(1)

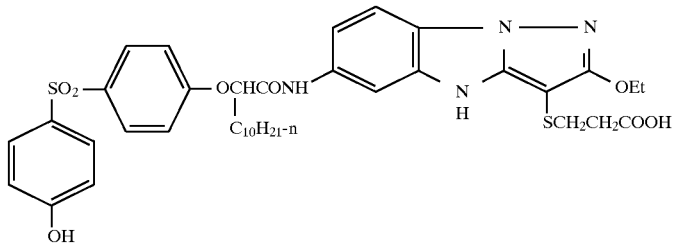

(2)

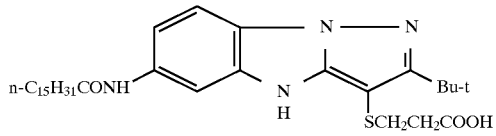

(3)

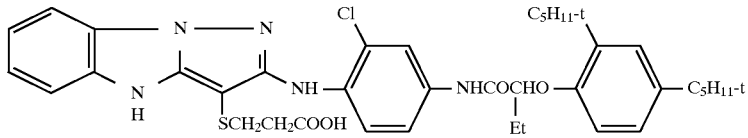

(4)

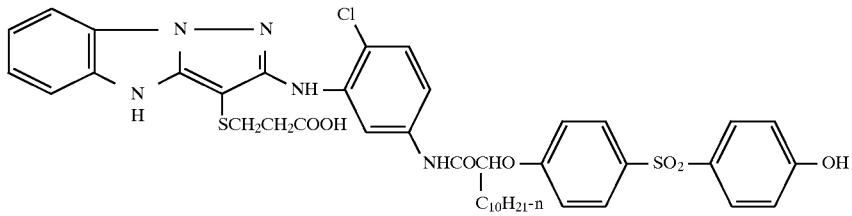

(5)

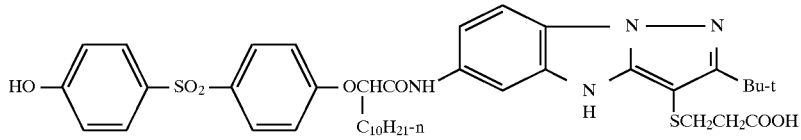

(6)

-continued
(7)
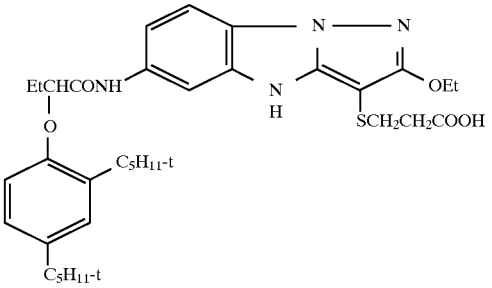
and
(8)
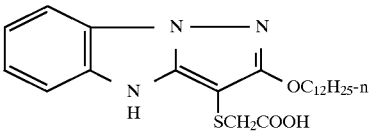
9. A process for forming an image in a photographic material according to claim 1 after the material has been exposed to light comprising contacting the element with a color developing agent.
* * * * *